United States Patent [19]

Hammons et al.

[11] Patent Number: 4,895,300

[45] Date of Patent: Jan. 23, 1990

[54] PASSIVE MAIL FACING DEVICE

[76] Inventors: James Hammons, 917 Old Taylor Rd.; James G. Vaughan, 66 Sheila Dr., both of Oxford, Miss. 38655

[21] Appl. No.: 322,990

[22] Filed: Mar. 14, 1989

[51] Int. Cl.[4] ..... B65G 11/04

[52] U.S. Cl. ..... 232/45; 193/8

[58] Field of Search ..... 232/45, 44, 30, 31, 232/32, 10; 108/136; 193/8

[56] References Cited

U.S. PATENT DOCUMENTS 4,434,931 3/1984 Hunt et al. ..... 232/31 X

FOREIGN PATENT DOCUMENTS 650989 9/1937 Fed. Rep. of Germany ..... 193/8

*Primary Examiner*—Robert W. Gibson, Jr.

*Attorney, Agent, or Firm*—William D. Stokes

[57] ABSTRACT

A mail facing device mounted behind and adjacent to a Post Office wall having a standard mail drop slot. Indicia is provided on the front of the wall adjacent the slot indicating the proper orientation of a letter for deposit and instructing the customer on how to insert the mail into the slot. A chute is provided between the slot and a bin for conveying the properly orientated mail to the bin where it is maintained in a properly orientated stack to facilitate further processing by the postal personnel.

9 Claims, 3 Drawing Sheets

FIG. 3
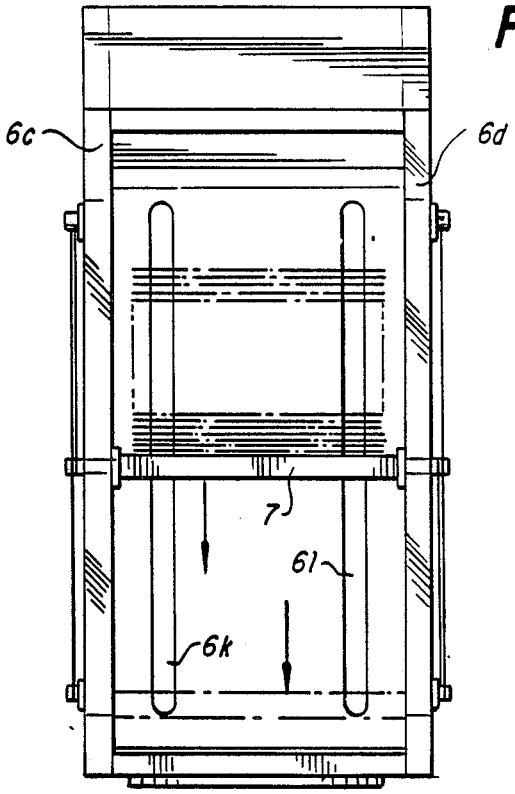
FIG. 5
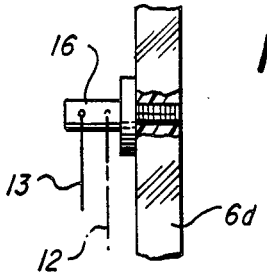
FIG. 6
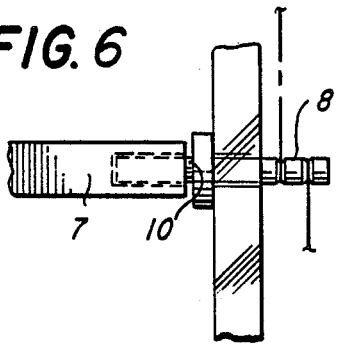
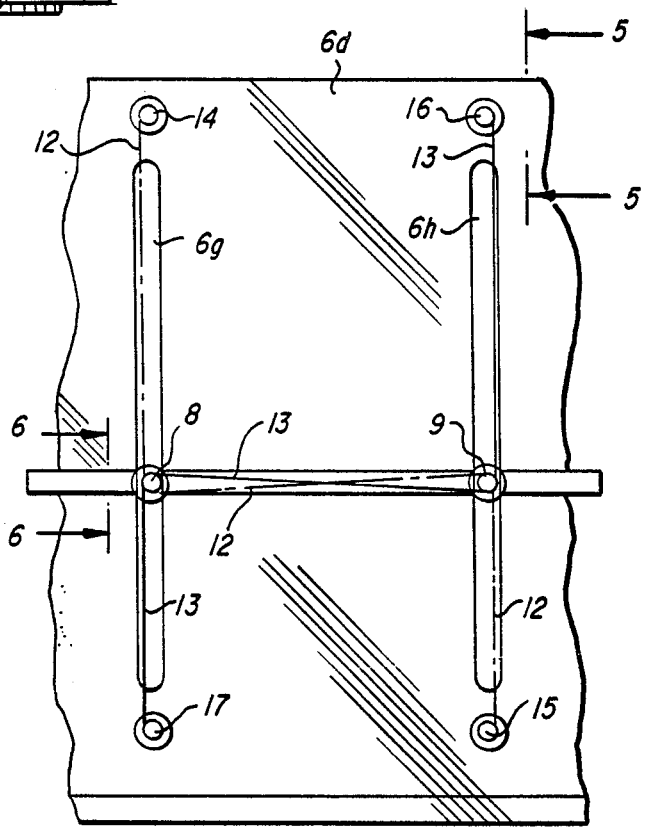
FIG. 4

PASSIVE MAIL FACING DEVICE

BACKGROUND OF THE INVENTION

Various mail facing devices have been proposed to facilitate the sorting of mail for its distribution. These devices customarily include a mailbox having a plurality of different compartments into which different types of mail may be placed by the customer so as to enable the postal employee to more easily and quickly cancel and sort the deposited mail. While these mail facing devices have been somewhat satisfactory for their intended purpose, the random order in which the mail was collected in each compartment required the postal employee to further orient or face each piece of mail before the postage could be cancelled and the letters sorted.

In order to increase the speed and ease by which deposited mail can be cancelled and sorted, the mail facing device of the present invention has been devised to maintain the proper orientation of the mail, i.e. "face" the mail, such that the upper right hand corner of a letter containing the postage stamp is maintained in the same position within a collected stack or bundle of mail. The device of the present invention comprises, essentially, a chute positioned behind and adjacent to a Post Office wall having a standard mail drop slot. Indicia is provided on the front of the Post Office wall adjacent to the standard mail drop slot showing the proper orientation of a letter and instructing the customer how to insert mail into the slot. The chute communicates with a bin having a horizontally disposed collection plate mounted in a collection bin. The collection plate is movable in a vertical plane within the bin and gradually moves toward the bottom of the bin as deposited letters become stacked thereon. A door is provided on one end of the bin so that a full bin of correctly faced mail can be emptied by the postal employee. The chute and bin are preferably constructed of transparent material to allow for constant viewing of the mail collection by a postal employee and intervention thereby in case of a problem.

BRIEF DESCRIPTION OF THE DRAWINGS

FIG. 3 is an end elevational view of the mail facing device showing a stack of deposited mail on the collection plate;

FIG. 4 is a fragmentary side elevational view of the bin illustrating one embodiment for suspending the collection plate in the bin;

FIG. 5 is a view taken along line 5—5 of FIG. 4;

FIG. 6 is a view taken along line 6—6 of FIG. 4;

DESCRIPTION OF THE INVENTION

Figures 1, 2:
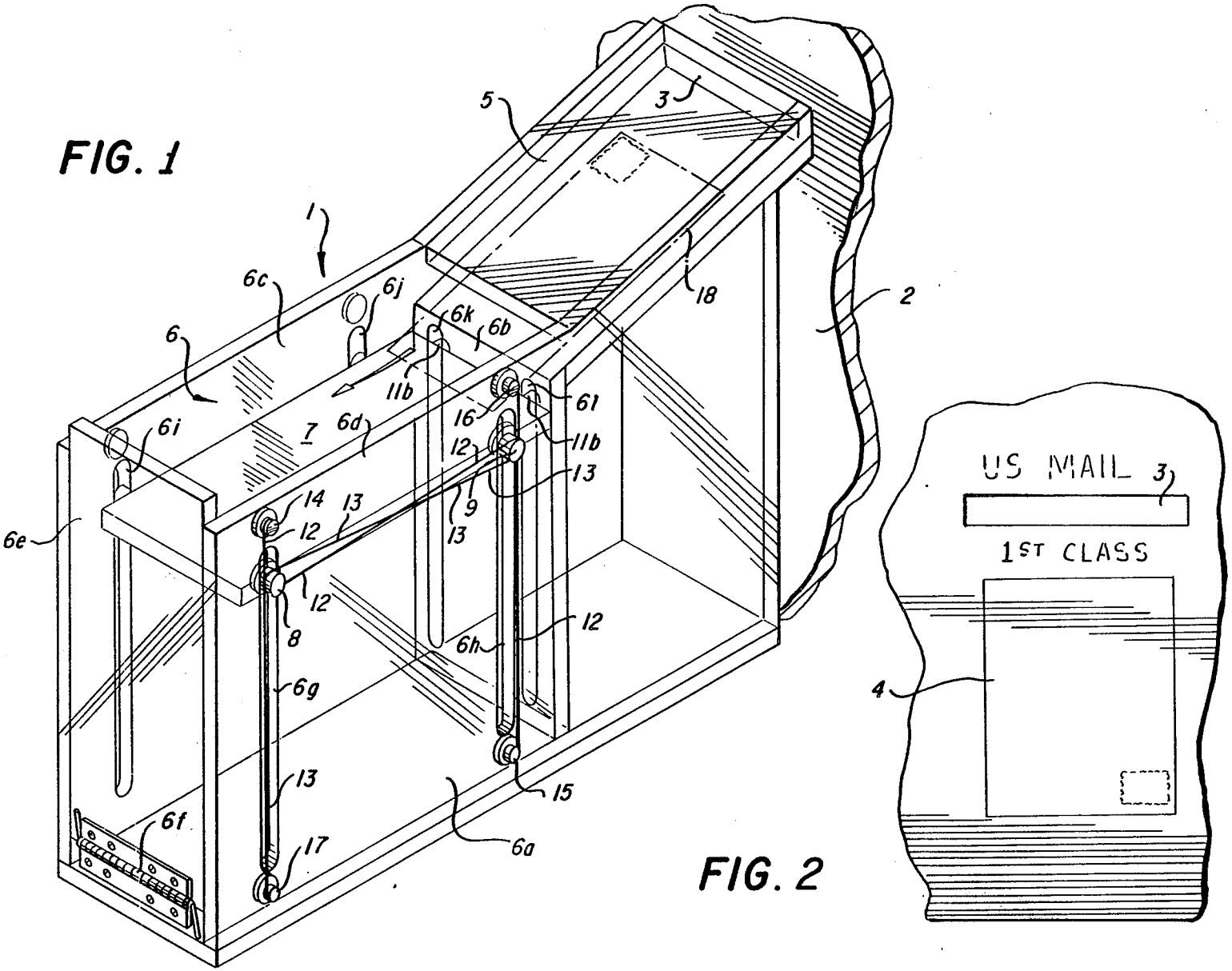
FIG. 1 is a perspective view of the mail facing device of the present invention.
FIG. 2 is a fragmentary front elevational view of a standard mail drop slot provided in a Post Office wall having indicia thereon instructing the customer as to the proper orientation of the mail to be inserted into the slot.

Referring to the drawings and more particularly to FIGS. 1 and 2, the mail facing device 1 of the present invention is mounted behind and adjacent to a Post Office wall 2 having a standard mail drop slot 3. Indicia 4 is provided on the front of the wall 2 adjacent to the slot 3 showing the proper orientation of a letter and instructing the customer how to insert mail into the slot.

The facing device 1 comprises an inclined chute portion 5 having its upper open end aligned with the mail drop slot 3 and its lower end communicating with a bin 6 having a horizontally disposed collection plate 7 mounted therein. The bin 6 has a bottom wall 6*a*, a fixed end wall 6*b*, side walls 6*c*, 6*d* and a movable end wall 6*e* hingedly connected to the bottom of the bin as at 6*f* to thereby provide a door for removing the stacked deposited mail from the bin.

The collection plate 7 is movable in a vertical plane within the bin 6 and guided therein by a pair of rollers 8 and 9, each roller being journaled on a shaft 10, FIG. 6, extending outwardly from the side edge of the collection plate 7 and through a respective vertical extending slot 6*g* and 6*h* provided in the side wall 6*f* of the bin. It is to be understood that similar rollers and slots 6*i* and 6*j* are also provided in the opposite side wall 6*c*. The collection plate is further guided by a pair of rollers 11*b* extending through vertical slots 6*k*, 6*l* provided in the end wall 6*b*.

The collection plate 7 is suspended for level movement within the bin 6 by a pair of cables 12 and 13. One end of cable means 12 is secured to a pin 14 secured to the side wall 6*d*. The cable 12 extends downwardly and looped underneath the roller 8 and then extends along the side wall 6*d* toward the roller 9. The cable 12 is looped over roller 9 and directed downwardly and secured at its opposite end to a pin 15 secured to the bottom portion of the side wall 6*d*. In the preferred embodiment the cable is a resilient or elastic material, the tension of which will counter balance the weight of the deposited mail facilitating a smooth downward movement of plate 7.

The cable 13 has one end similarly secured to a pin 16 secured to the top portion of the side wall 6*d*, the cable extending downwardly and looped underneath the roller 9 and along the side wall 6*d* where it is looped over roller 8 and secured at its opposite end to a pin 17 secured to the bottom portion of the side wall 6*d*.

A similar cable suspension system is provided along the opposite side wall 6*c*, as shown in FIG. 3, and fixed end wall 6*b*. It will be appreciated that the suspension systems stabilize plate 7 front-to-back and side-to side in the event the weight of the envelopes collect unevenly.

In use, the customer properly orients the mail for deposit in accordance with the instructions 4 on the front of the Post Office wall. The properly oriented letter 18, FIG. 1, is inserted through the slot 3 and it slides down the chute 5 onto the collection plate 7. As the deposited mail accumulates on the collection plate 7, a stack of properly oriented mail (not numbered), is formed as shown in FIG. 3. As the weight of the stacked mail increases, the collection plate 7 will move downwardly toward the bottom of the bin until the bin is full. At which time, the postal employee will open the door 6*e* of the bin, remove the stack of properly oriented mail for further processing, and slide the collection tray 7 upwardly toward the chute 5 to restart the collection process.

The chute 5 and bin 6 are constructed from transparent material to allow for constant viewing of the mail collection and operator intervention in case of a problem.

While the facing device has been described for use in collecting letter size mail, it will be understood by those skilled in the art that the device can be constructed and arranged to be placed adjacent a mail drop slot dimensioned to receive larger pieces of mail such as "flats". If the collection plate 7 is properly dimensioned for the intended mail size and is sufficiently close to the mail drop slot, then mail inserted through the drop slot will not have an opportunity to change orientation.

As the mail collects on the plate 7, the plate is caused to move downwardly within the bin 6 so as to maintain the proper position of the top surface of the collection plate 7 relative to the lower end of the chute 5.

Figure 7:
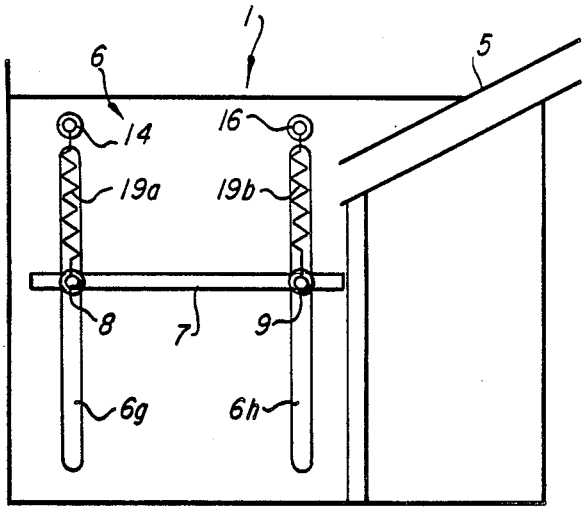
FIG. 7 is a diagrammatic, side elevational view illustrating another embodiment for suspending the movable collection plate within the bin.

While this downward movement of the collection plate 7 is guided and stabilized by the cable and roller arrangement shown in FIGS. 1 to 6, another arrangement is shown in FIG. 7 wherein a pair of tension springs 19*a* and 19*b* are connected between pin 14 and roller 8, and pin 16 and roller 9, respectively, similar tension springs being provided on the opposite side of the plate 7, whereby as the deposited mail becomes stacked on the plate 7, the weight thereof will cause the plate 7 to move toward the bottom of the bin 6 extending the tension springs 18 and 19 so that when the bin is emptied, the springs will contract to raise the plate vertically upwardly to a position adjacent the chute 5.

Figure 8:
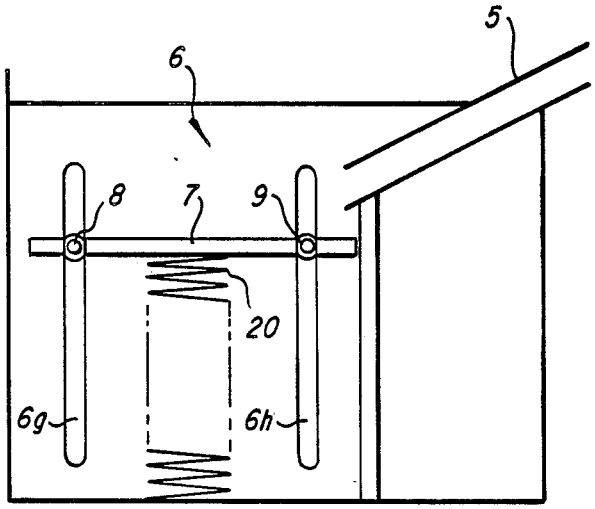
FIG. 8 is a diagrammatic, side elevational view illustrating yet another embodiment for suspending the movable collection plate within the bin.

FIG. 8 illustrates another embodiment for controlling the movement of plate 7 wherein a compression spring 20 is mounted between the bottom surface of the plate 7 and the bottom wall of the bin 6 to thereby provide an upwardly biasing force to the plate 7.

Figure 9:
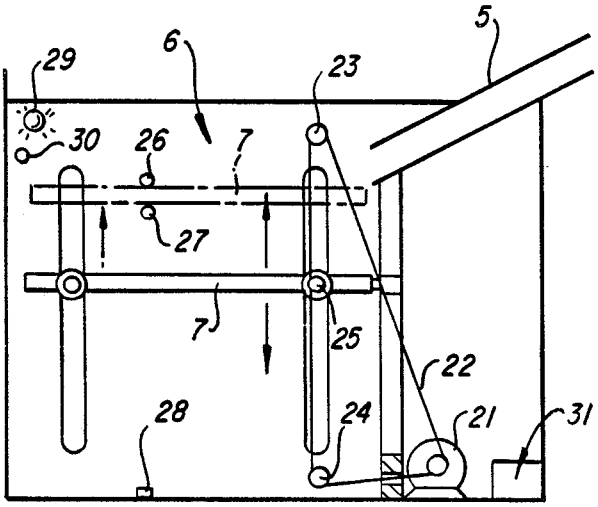
FIG. 9 is a diagrammatic, side elevational view illustrating still another embodiment for suspending and operating the collection plate within the bin.

FIG. 9 illustrates yet another embodiment for controlling the movement of the plate 7, wherein a stepper drive motor 21 is provided having a drive belt 22 connected to upper and lower rollers 23 and 24 mounted on the bin 6, and a roller 25 mounted on the side edge of the collection plate 7. A pair of optoelectronic sensors 26 and 27 are mounted on the upper portion of the bin 6 for maintaining the proper position of the top of the mail stacked on the plate 7 with respect to the lower end of the mail chute 5. Another optoelectronic sensor 28 is mounted on the lower portion of the bin 6 for detecting the bottom position of the mail collection plate 7. An indicator 29, such as a light and/or an audible signal, is mounted on the bin 6 to warn the postal employee that the full plate 7 is at the bottom of the bin 6, and a reset button 30 is provided to reset the position of the empty collection plate 7 to the upper portion of the bin adjacent the lower end of the chute 5 to allow continued collection of the mail. The motor 21, upper sensors 26, 27, lower sensor 28, indicator 29, reset button 30 are all electrically interconnected by a power supply and electronic logic package designated generally at 31.

In the operation of the mail facing device of FIG. 9, the sensors 26 and 27 provide feedback to the drive motor logic 31 to maintain the top of the mail stack on the collection plate 7 at a desired position relative to the lower end of the mail chute 5. Depending on the position of the top of the mail stack with respect to the sensors 26 and 27, the stepping motor 21 is activated in a direction to cause the plate 7 to move successively downwardly toward the bottom of the bin, whereby the top of the mail stack on the collection plate 7 is maintained at the desired position relative to the mail chute 5. The two sensors 26 and 27 are employed to allow some leeway in the actual position of the collection plate 7. The top sensor 26 will control the position of the plate 7 in response to the top of the mail stack, while the lower sensor 27 will set the lower position threshold for optimum stack angle. Use of the two sensors 26 and 27 also prevents the stepping motor 21 from being constantly energized to thereby provide a longer lifetime of operation.

As mail continues to be collected on the plate 7, the sensors 26 and 27 are activated and the stepping motor 21 is energized to move the collection plate incrementally downwardly. When the plate 7 reaches the bottom of its travel, the third sensor 28 is activated to not only de-energize the stepper motor 21 but also to activate the indicator 29 to alert the postal employee that the bin 6 is full and that the stack of mail should be removed from the collection plate 7. Once the mail is removed from the bin, the reset button is pushed to activate the motor 21, whereby the collection plate 7 is moved upwardly to the top of the bin 6, to thereby re-position the collection plate 7 in proximity to the lower end of the mail chute 5 for the reception of deposited mail.

It will be recognized by those skilled in the art that any of the embodiments shown in FIGS. 7, 8 and 9 may be effectively used in combination with the cable means of FIG. 1 to provide additional control of the downward movement of the receiving plate.

From the above description, it will be appreciated by those skilled in the art that the mail facing device of the present invention is characterized by its simplicity of construction while at the same time providing a mail facing device which facilitates the speed and ease by which deposited mail can be cancelled and sorted by the postal employee.

It is to be understood that the forms of the invention herewith shown and described are to be taken as preferred examples of the same, and that various changes in the shape, size and arrangement of parts may be resorted to, without departing from the spirit of the invention or scope of the subjoined claims.

What is claimed is:

1. A mail facing device comprising, a chute, one end of said chute being positioned behind and adjacent to a Post Office wall having a standard mail drop slot, indicia provided on the front of said wall adjacent to said slot indicating the proper orientation of a letter for deposit and instructing the customer on how to insert mail into the slot, and a bin, the opposite end of the chute communicating with a horizontally disposed collection plate slidably mounted in a verticle plane within the bin, whereby properly orientated mail inserted through the mail slot is conveyed by the chute onto said collection plate where it is stacked in the proper orientation to facilitate the further processing of the deposited mail by the postal personnel and means operatively connected to the collection plate for controlling the movement of the plate within the bin.

2. A mail facing device according to claim 1, wherein the means for controlling the movement of the collection plate comprises, a plurality of pins secured to the bin, a plurality of rollers mounted on the collection plate, and cable means operatively connected between said pins and said rollers, whereby the weight of the stacked mail will cause the collection plate to move incrementally from a position from the top portion of the bin adjacent to the opposite end of the chute to a position at the bottom of the bin.

3. The mail facing device of claim 2, wherein the cable means are of an elastic material.

4. A mail facing device according to claim 1, wherein the means for controlling the movement of the collection plate comprises a plurality of tension springs mounted between the bin and the collection plate.

5. A mail facing device according to claim 1, wherein the means for controlling the movement of the collection plate comprises, a compression spring mounted between the bottom surface of the collection plate and the bottom wall of the bin.

6. A mail facing device according to claim 1, wherein the means for controlling the movement of the collection plate comprises a stepper drive motor, a drive belt connected between the motor and the collection plate, first sensor means mounted on the upper portion of the bin for maintaining the proper position of the top of the mail stacked on the plate with respect to the opposite of the mail chute, second sensor means mounted on the lower portion of the bin for detecting the bottom portion of the mail collection plate, a power supply and electronic logic package electrically connected to the first and second sensor means, and the drive motor.

7. A mail facing device according to claim 5, wherein an indicator is mounted on the bin and electrically connected to the second sensor means to warn the postal employee that the plate of stacked mail is at the bottom of the bin.

8. A mail facing device according to claim 1, wherein the bin includes bottom, side and end walls, one end wall being hingedly connected to the bin to provide a door to facilitate access to the bin.

9. A mail facing device according to claim 8, wherein a plurality of slots are provided in the side and other end wall of the bin, a plurality of rollers mounted on the collection plate and extending through said slots to thereby stabilize the collection plate within the bin.

* * * * *